United States Patent [19]

Bernauer

[11] Patent Number: 4,541,336

[45] Date of Patent: Sep. 17, 1985

[54] METHOD AND DEVICE FOR CONTROLLING THE SUPPLY OF INK TO THE INKING UNITS OF A MULTI-COLOR PRINTING PRESS

[75] Inventor: Joachim Bernauer, Frankenthal, Fed. Rep. of Germany

[73] Assignee: Albert-Frankenthal AG, Fed. Rep. of Germany

[21] Appl. No.: 595,212

[22] Filed: Mar. 30, 1984

[30] Foreign Application Priority Data

Apr. 20, 1983 [DE] Fed. Rep. of Germany ..... 3314333

[51] Int. Cl.[4] ..... B41F 31/00

[52] U.S. Cl. ..... 101/211; 101/181; 101/365

[58] Field of Search ..... 101/365, 211, 426, DIG. 26, 101/DIG. 24; 356/444; 350/358, 360; 250/559; 358/201, 235; 310/313 R

[56] References Cited

U.S. PATENT DOCUMENTS 3,756,725 9/1973 Manring ..... 101/365 X 3,944,732 3/1976 Kino ..... 358/201 X

*Primary Examiner*—J. Reed Fisher

*Attorney, Agent, or Firm*—Jones, Tullar & Cooper

[57] ABSTRACT

In the operation of a multi-color printing press an accurate and at the same time economic control of the inking of the printing plate or the like is made possible by converting the optical frequencies of light reflectance from inking zones (i.e. the zones controlled by the different fountain keys or the like) of the products printed on the press into representative acoustic frequencies which may be processed by electronic signal processing circuitry.

The conversion of the light reflectance (diffusely reflected light from the printed image) into acoustic frequencies is undertaken by a light-pressure transducer with a microphone whose electrical output signal goes to a variable frequency filter means with a scan function such that narrow frequency sub-ranges are produced that are processed spectrally in keeping with the intensity thereof. The resulting intensity signals are related to the inks used in the press and converted into adjustment signals for the operation of ink fountain keys or the like controlling the inking rate is separate zones of the press.

22 Claims, 2 Drawing Figures

METHOD AND DEVICE FOR CONTROLLING THE SUPPLY OF INK TO THE INKING UNITS OF A MULTI-COLOR PRINTING PRESS

BACKGROUND OF THE INVENTION

In keeping with a first aspect the present invention may be said to be with respect to a method for the control of ink fountain means of the inking units of a multi-color printing press so that the degree of inking of different zones of the press across the width thereof may be controlled as desired, and more specially to a way of controlling or automatically adjusting the settings of the fountain blade keys as controlling the zone-by-zone ink supply rate.

In keeping with a further aspect, the invention may be said to relate to a device for use in such a method.

DISCUSSION OF THE PRIOR ART

It is current practice for test strips to be printed at the edge of the printed image on the paper for checking the uniformity of the inking action. These test strips are made up of full density or full tone patches for each of the different inks and for each of the ink zones. Such solid tones are examined with a densitometric instrument so that they may be compared with a reference or set value to see if there is a shortage or over-supply of the ink. A shortcoming in this respect has been that the test strips take up a certain amount of the area of the material as printed on one circumference of a cylinder. This is not only a loss of the otherwise available area but furthermore time and labor are wasted for trimming off the said test strips when a printed web is being further processed, after coming off the press, to make products in sheet form. A further shortcoming is that there is a very coarse resolution of the color spectrum, that is far removed from what may be seen by the human eye. In fact, the color spectrum is only resolved into three patches answering to the basic colors. However under working conditions it is quite possible for the inks used to have amounts of other inks mixed in with them so that, for example, blue ink may have to slight red hue or the like. However, with the said coarse resolution of the color spectrum such as hue is quite likely not be detected and the outcome of this may well be that when blue and red are printed on top of each other the proportion of red may be seen to be excessive and the amount of blue will not be large enough, although the full density patches of the test strip are in line with the reference value. The possible printing quality will then not be in line with tight requirements.

SHORT OVERVIEW OF THE PRESENT INVENTION

In view of these facts in connection with the prior art, one purpose of the invention is that of overcoming the shortcomings encountered hitherto in the art and of making possible a method of the sort noted that may be run without needing test strips but nevertheless makes possible high quality printed products.

In keeping with a further aspect the invention is to make possible a device for undertaking the method of the invention, that is simple in its mechanical design while at the same time making possible highly accurate operation.

From the method or process aspect, the said one purpose of the invention may be surprisingly simply effected by a method in which optical frequencies representative of the light reflectance from a printed product produced on the press and answering to the breadth of at least the inking zone as controlled by one ink fountain key of each of the ink fountains, are converted into acoustic frequencies and detected spectrally and intensitywise and the intensity readings or values so produced are related to the inks used for the production of the multi-color printed product and are converted into setting signals for controlling the supply rate of the inks used.

In keeping with a further part of the invention a device for effecting the said purpose is characterized by at least one light-pressure transducer to be acted upon by the light reflectance in at least one zone of a printed product from the press to be acted upon by light, an acoustic sensor for sensing the output signals of the said transducer, an acoustic receiver for such signals, a variable frequency filter means for causing division of the representative spectrum coming from the acoustic receiver into a desired number of frequency sub-ranges, a processing means for the zonewise processing of the output values of said filter means for the separate frequency sub-ranges and the conversion thereof into adjustment values for the setting of the zonewise ink supply rates in the production of a multi-color printed product.

Turning the optical frequencies of the colored light reflectance from the printed product into acoustic frequencies gives the useful effect of making possible a frequency filtering operation without any loss in intensity. The overall intensity of the circularly polarized light for this reason plays a part in producing the result. Special polarization of the light, that would cause losses in intensity, is not needed, thus resulting in a further benefit of the invention. For this reason the readings produced have a very high intensity level so that the effect of interference on the readings produced is low, this being a further useful effect. At the same time the conversion of the optical frequencies into acoustic ones makes possible the use of acoustic sensors, that have the useful property of not only being very sturdy but furthermore having an equal sensitivity all over the spectrum. A further useful effect made possible by the invention is that the device may be made without any moving parts to the optical system and no geometrical projection of the printed product is needed. In fact, the light pressure transducer may be used with an input light current of any desired form, this being a useful point in connection with the design of the optical system. One highly useful effect of the invention is furthermore the fact that highly selective sensitivity becomes possible; to put it differently it may be said that the division of the spectrum in the acoustic part of the system may to good effect be undertaken so finely that the resolution of the received frequency band stretching over the full optical spectrum is on a par with the resolution of the human eye. Generally the system in keeping with the invention gives an intensity curve, that is very truly representative of the coloration of the printed product over all of the spectrum so that the half tones and the like spectrally placed in the transition zones, may be quite readily detected and correlated with the spectral range of the inks used. The fine graduation or fine screen size furthermore gives the useful effect of making possible the use of inks with color shades different from the shades of standard inks without this having any undesired effect on the outcome so that the versatility of the printing press with respect to the inks that may be used on it is increased. It will be seen from the observations so fat that the purposes of the invention may be effected with simple components and means that are low in price. The useful effects possible with the invention are more specially to be seen in the highly economic design and operation of a printing press in keeping with the invention.

Light-pressure transducers are, it is true, a known component for the conversion of a light signal into a representative acoustic signal, however devices of this sort have so far only been used for the examination of the nature of the composition of a liquid or of a gas. In this case the medium to be examined in the light-pressure transducer was acted upon by monochromatic light and the acoustic signal able to be detected by an acoustic sensor was able to be related to the material properties of the medium. However, it is clear that such a known apparatus does not give any suggestion about the design and basic idea or combination of the present invention.

Furthermore there has been a suggestion in the prior art to use a so-called acoustic-optical filter for measuring the intensity of light over the full spectrum. Such acoustic-optical filters are excited by way of an oscillator and may only be used with a given frequency range as dependent on the excitation. Systems of this nature have so far been used for the polarization of light in optic fiber systems. However it will be clear that polarization of the light is then necessary and then a large amount of the intensity of the light will be lost. For this reason the readings or output signals will have a very low level so that trouble through interference is likely. It will be clear that in this case as well the prior art does not have any suggestion going towards the present invention.

As a useful further development of the invention the light-pressure transducer is acted upon by light that is pulsed with the inherent frequency of the transducer, this giving the useful effect of self-amplification.

To make possible simple calibration of the device in keeping with the invention the intensity values of reflectance from a given printed product may be compared with the intensity values produced with the full light strength or level and the intensity value differences may be changed into setting or servo signals, more specially after comparison with representative reference signals.

For producing the right form of evaluation curve it is best to make use of light with a standard spectrum, as for example amplified daylight.

In keeping with a further useful development of the invention in the case of a web-feed printing press the moving web being printed is used as the sample printed product examined by the device of the invention, the light reflectance therefrom being integrated over a certain path, that is more specially equal to a cylinder circumference. This measure is useful inasmuch as it makes possible continuous monitoring of the inking effect on the footing of the moving web and inasmuch as a very quick response is possible.

In keeping with a further outgrowth of the invention the frequency intensity may be measured or detected within 10 to 20 and preferably 15 equally wide frequency sub-ranges. Such frequency sub-ranges may be filtered out without loss of intensity—another useful effect—on the acoustic side from the frequency band as received by using a so-called panorama receiver. The division of the frequency band into 10 to 20 and more specially 15 frequency sub-ranges makes possible the useful effect of a 4 to 5 times finer resolution than is possible with the prior art three filter method. It is best in this respect for the separate frequency sub-ranges to be filtered out from the received frequency band one after the other. To do this the output side of the panorama receiver may be joined up with a frequency scanning filter that may be set to any desired frequency range by a processor so that it may be interrogated with respect thereto, or in other words a frequency sweep takes place. This measure makes it possible for one variable frequency filter only to be used which is set and changed in its response as desired for scanning the frequency band, this making calibration much simpler.

As a further part of the general idea on which the present invention is based, the or each light-pressure transducer may be in the form of a glass body so that, as a useful effect, a high degree of accuracy becomes possible, while the transducer means itself is low in price.

Further developments and useful effects of the invention will become clear from the account now to be given of one working example thereof to be seen in the figures herein.

LIST OF DIFFERENT VIEWS OF THE FIGURES.

DETAILED ACCOUNT OF THE WORKING EXAMPLE OF THE INVENTION

Figure 1:
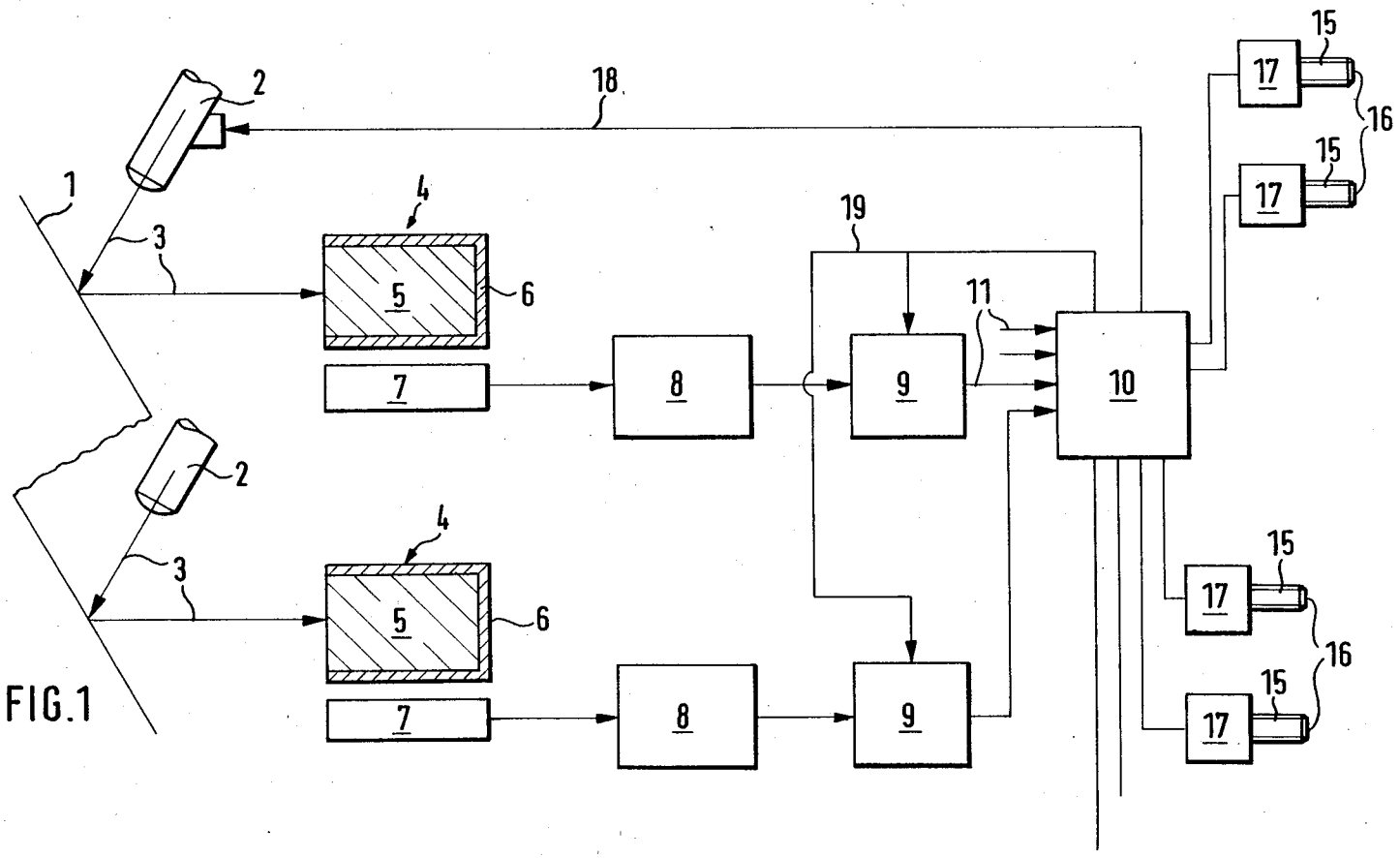
FIG. 1 is a block schematic of a control device in keeping with the present invention. .

It is taken to be the case that the workings and mechanical design of a multi-color printing press, as for example in the form of a letterpress, or more specially an offset web-feed press, will be familiar to the reader so that no detailed account of parts thereof not immediately relevant to the present invention will be needed here. In FIG. 1 the material to be multi-color printed in such a web-feed press is to be seen in the form of a paper web 1, that is only marked diagrammatically. The quality of printing is dependent more specially on the right inking of the plate or type and over- or under-inking will both be responsible for undesired effects. Because the desired ink density is however to be different across the width or breadth of the machine, the breadth is divided up into a number of zones inasmuch as there are keys along the ink fountain for separate or zonewise adjustment of the ink supply rate. In the present case the adjustment of the keys (not shown) is undertaken in keeping with readings taken in the zones in question of the printed image on the paper web 1 so that a number, equal to the number of the zones, of automatically controlled objects or elements are present in which the desired inking rate is to be kept up.

The signals to be detected in the present case are in the form of the colored light reflectance, as produced by the action of a light source, from the printed image on the printed product. In the case of a sheet-feed press the printed product sample may be in the form of a sheet taken from the current production run. As noted earlier, in the case of a web-feed press the printed product is best in the form of the printed web itself or of a section thereof equal to the size of the circumference of a plate cylinder. For each zone there is one light source 2 shining light onto the printed product. The best light is light with a known spectrum or spectral curve so that exactly reproducible results are made possible. One form of light that may well be used is light with a spectrum the same as that of daylight. As a source for producing amplified daylight use may be made of daylight lamps with a color temperature of 4000 to 5000K. The lamps 2 for the zones placed side by side of the paper web 1 are best positioned next to the paper at the point where it runs into a folder coming after the press. The lamps may be so out of line from each other in the direction of running of the paper web that the lamps do not interfere with each other in their action if they are all in operation at the same time. Another way of cutting out possible interference is for the lamps 2 or light sources to be switched on in turn in a given order.

The light coming from each light source 2 and shining on the paper web 1 in the zone to be illuminated by the lamp, designated by the ray path 3, undergoes diffuse reflection, i.e. reflectance, at the web. The reflectance light then goes to a light-pressure transducer 4 in the form of a component containing an anistropic medium that is to say a medium whose reaction to light is such as to be able to produce a response in the form of a different frequency signal within the acoustic spectrum for each and every frequency in the visible spectrum. In this respect use may be made of a chamber filled with gas or a liquid. In the present working example as figured use is made of a glass body 5 with a crystalline structure, such glass being so doped with impurity atoms that the same uniform light pressure is generated over the full spectrum. The glass body 5 is placed in a housing 6, that is open on the light input side. For causing amplification of the light pressure produced, it is best for it to be acted upon by light pulsed with a frequency in keeping with the natural or inherent frequency of the light-pressure transducer 4 in question so that because of this resonant phenomena come into play. In the working example of the invention to be seen in FIG. 1 each zone of the paper web 1 has its one light source 2 with its light-pressure transducer 4 coming thereafter. For this reason such units may be stationary, although it would be possible to have a system with one single unit adapted to be moved over the width of the paper web.

The output signals of the light-pressure transducers 4, whose number is equal to the number of zones on the web, go to an acoustic sensor 7 (in the form of a microphone placed on the light-pressure transducer in question) and the output signals of the said sensor produced in response thereto go to an acoustic receiver 8 in the form of a so-called panorama receiver having the property of receiving all the frequencies in the spectrum. For this reason each receiver 8 for each zone gets an acoustic spectrum as an input that is representative of the light supplied in each case to the light-pressure transducer in question. And the intensity of the received acoustic frequencies is an exact measure for the intensity of the optical frequencies of the reflectance (diffusely reflected) light and so for the intensity of the inking of the printed image on the scanned paper web 1. The acoustic frequencies produced by the receivers for each zone are detected spectrally in keeping with their intensities and for this purpose the complete spectrum is divided up into a number-as large as may be needed—of frequency bands or sub-ranges that are next to each other without overlapping. A division into 10 to 20, or more specially into 15 equally wide frequency sub-ranges has turned out to give good effects. The sub-ranges are filtered out from each spectrum as received by the receivers 8.

To make this possible the outputs of the receivers 8 are each joined up with a variable frequency filtering unit 9, that may be made up of a number, equal to the number of desired sub-ranges, of separate variable frequency filters, each one being for one frequency sub-range. In the present working example, however, there is in each case only one variable frequency filter for forming the variable frequency filtering unit 9, that may be adjusted to the desired frequency sub-ranges to make calibration simpler with a sweep or scanning function. There is a central computer or processor 10 controlling the frequency of the variable frequency filters 9, and scanning or sweeping through all the frequency sub-ranges of the variable frequency filters 9 that are is joined up to it. In this respect the interrogation or scanning time is very short so that the readings for a given zone are produced and on hand more or less instantly. The computer 10 may in this respect normally interrogate or scan the variable frequency filters 9 of all the zones at the same time. To make this possible the computer 10 has the right number of input ports 11. The frequency sweep signals for the filters 9 are supplied by way of the branching control line 19.

Figure 2:
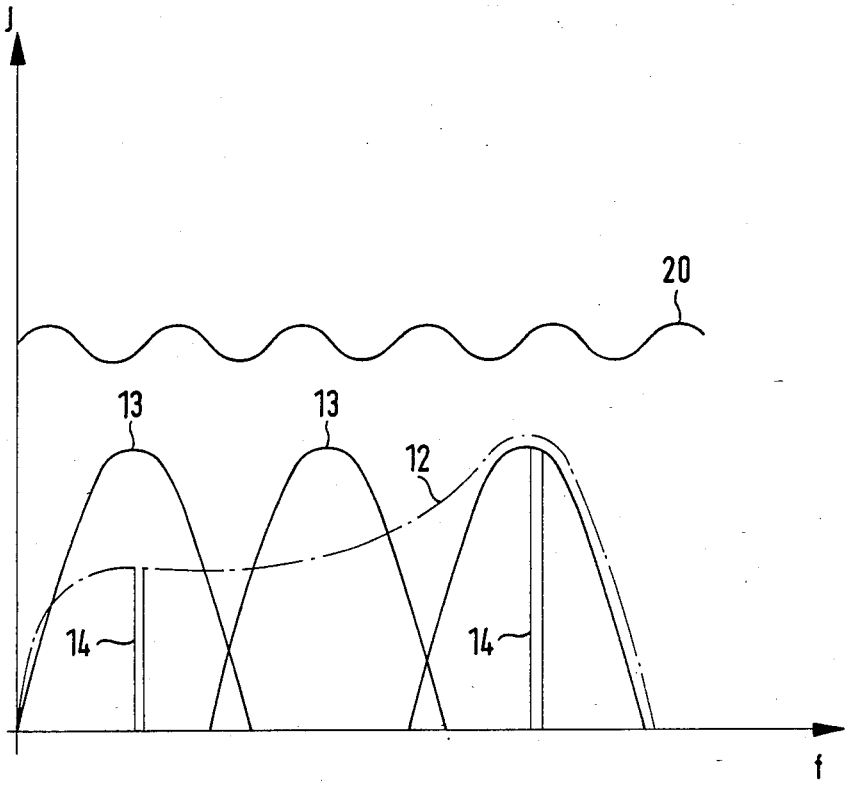
FIG. 2 is a intensity-frequency graph

On the basis of the intensity scan readings produced with respect to each zone and in its frequency range the computer 10 plots an intensity curve 12 running through the complete spectrum, such curve having for example the form marked in broken lines in FIG. 2 and being able to be used for adjustment of the fountain keys for zonewise inking rate adjustment with respect to the spectral ranges answering to the basic ink colors yellow, red and blue used so that from this the setting or control signals for driving the fountain keys of the inking units placed one after the other along the press may be generated. Each basic ink color may be plotted in the graph as in FIG. 2 as a parabolic intensity curve 13 (marked in full lines in this figure), there being some overlap at the edge parts so that a division of the full spectrum on the basis of a three-element screen would be responsible for inaccuracies and this is the reason that in the present case the full spectrum is divided into a number, more specially 15, of narrow non-overlapping frequency sub-ranges 14, thus making possible a very fine resolution and a good level of coordination even in the overlap parts of the three-element color screen. To work out the amounts of adjustment of the fountain keys for the different inks it is simply necessary to integrate the areas bordered by the curve 12 of the frequency sub-ranges 14, within each said color intensity curve 13, over the separate color intensity curves 13 and to make a comparison between the figures so worked out with the area of the color intensity curve 13 in respect thereof. The difference so worked out is used for producing the adjustment amount or value. Because of the fine division of the full frequency band, in the overlap ranges of the intensity curves 13 a simple correlation between the sub-ranges 14 and the one or other ink color becomes possible.

The central processor or computer 10 may generally be looked upon as a central evaluating unit, that may be used for driving all the fountain keys 15 of all press inking units. The fountain keys 15 of the inking units on the different printing units, placed one after the other, of the press, for one and the same zone of the web in the present case form one of a number of key groups 16, each such group having a light-pressure transducer 4 with a light source 2 on its input side and a receiver 8 on its output side so that the input and processing of data is possible at the same time. However, as noted earlier in the present account, it would be quite possible to have only one receiving or detecting unit that would simply be moved from one zone to the other. Each fountain key 15 has its own separate driving or servo motor 17 worked by the processor 10, with the necessary number of output ports for operation of such motors.

In the event of the moving paper web 1 being used as a sample printed product examined by the system of the invention, as in the present case, the light sources 2 for the different zones are switched by way of a signal line 18 coming from the processor 10 in such a way that the paper web 1 is illuminated (by way of a light flash) only over a web length equal to the circumference of a cylinder, or to a whole number multiple thereof. In this respect, as noted earlier herein, the light used for illumination is pulsed with a frequency in keeping with the natural frequency of the light-pressure transducer 4 in question to make possible amplification, as desired, and to give a simple integration of the light values or readings over the section of the web being scanned. There are control lines 19 coming from the central processor 10 for the control of the variable frequency filters 9.

The amounts of adjustment to be effected by use of the servo motors 17 are worked out by comparison of the readings with reference values stored in the processor 10 and produced in the first place by testing an original, as for example the original from which the prints are to be produced on the press. In the event of there being any deviations, the amounts thereof are turned into control signals for driving the servo motors 17 for the different fountain keys 15. For calibration of the system generally use is made for each zone of an evaluation curve of the sort marked at 20 in FIG. 2. Such a curve will have been produced by causing each light-pressure transducers 4 to be acted on directly by the light source 2 therefor, that is to say not acted upon by the light reflectance from the paper web 1 but by the light coming straight from the said light source. The deviations produced on comparison between the intensity curve 12 and the evaluation curve 20 are related to the reference values as produced in the same way from an ideal printed product. The deviations so produced are changed into the key adjustment signals for the different inks. In many cases there is something to be said as well for producing the evaluation curve 20 by processing the light coming from unprinted paper web. This will be more specially of value in the case of tinted or colored papers.

I claim:

1. A method for controlling the rate of supply of printing ink to a printed product passing through a multicolor printing press in separate zones spaced across the width of the press, comprising the steps of:

directing light from a light source to a material printed on the product in at least one zone at a time;

sensing the light reflectance from the material printed on the product in each zone to which light is directed;

converting the sensed light reflectance into a signal having acoustic frequencies dependent on the level of different optical frequency components of the sensed light;

providing a division of the complete acoustic frequency spectrum into a desired member of frequency sub-ranges, and arranging the converted acoustic frequencies into frequency sub-ranges related to the intensity of the ink colors used; and generating servo signals from the frequency sub-ranges for adjusting the printing ink supply across the width of the press.

2. The method as claimed in claim 1 wherein said light is pulsed and has a known spectrum.

3. The method as claimed in claim 2 wherein said light is amplified daylight.

4. The method as claimed in claim 1, wherein the frequency sub-ranges are compared with reference values to produce the servo signals.

5. The method as claimed in claim 4, wherein the reference values are values produced from an ideal representation of the image that is printed.

6. The method as claimed in claim 4, further comprising the step of:

directing light from the light source or the means for sensing the light reflectance to produce thereby an evaluation curve.

7. The method as claimed in claim 4, wherein the multi-color printing press comprises a web-feed press having a press cylinder and the printed product sensed comprises the printed web before cutting down to size, and wherein the light reflectance is sensed and integrated over a length of the web equal to X times C, wherein C equals the press cylinder circumference and X is a whole number equal at least to unity.

8. The method as claimed in claim 1, wherein the light reflectance is sensed in each zone at the same time.

9. The method as claimed in claim 1, wherein the frequency sub-ranges are provided by sweeping converted sensed light reflectance signal, and wherein the frequency sub-ranges produced are over-lap free.

10. The method as claimed in claim 9 wherein said sub-ranges are of the same width.

11. The method as claimed in claim 9 wherein said sweep is caused by changing the frequency of a filter.

12. The method as claimed in claim 9 wherein between 10 and 20 such sub-ranges of equal breadth are produced.

13. A device for controlling the rate of supply of printing ink to a multi-color printing press having:

a plurality of inkings units each including means for changing the rate of inking in separate zones spaced across the width of the press; and at least one unit for examining the ink in an area of printed product passing through the press, said area having been printed in one of said zones, the unit comprising:

a light source for directing light onto the printed product;

a light transducer for sensing the light reflectance of the light from the printed product area and generating a signal or a function thereof;

an acoustic sensor connected to the light transducer for detecting the signal generated by the light transducer and converting the detected signal to an acoustic signal.

an acoustic receiver connected to the acoustic sensor for receiving the acoustic signal output from the acoustic sensor and producing a frequency band output signal;

variable frequency filter means connected to the acoustic receiver for receiving the frequency band output signal from the acoustic receiver, converting the frequency band output signal into a desired number of sub-bands and producing an output signal representative of each sub-band; and evaluating means connected to the variable frequency filter means for receiving the output signals from the variable frequency filter means and converting said output signals into servo signals applied to the inking units for adjusting the inking rate across the width of the press in the zones.

14. The device as claimed in claim 13, wherein the evaluating means includes a processor which sweeps the variable frequency filter means for scanning the frequency band output signal from the acoustic receiver.

15. The device as claimed in claim 14, wherein a light source and a corresponding light transducer acoustic receiver and variable frequency filter means are provided for each zone, wherein the evaluating means includes a computer connected to each variable frequency filter means and to each inking unit, and wherein each inking unit includes inking keys and a servo motor for controlling the inking keys, said servo motors responding to the generated servo signals.

16. The device as claimed in claim 13, comprising for each said zone of said press one such light transducer one such light source, one such receiver for receiving output signals from said transducer, and one such variable frequency means for sweeping the frequency band signal of said receiver.

17. The device as claimed in claim 13 comprising a glass body within said transducer.

18. The device as claimed in claim 17 wherein said glass body is so doped with impurity atoms that said light pressure is materially uniform over the full spectrum.

19. The device as claimed in claim 17 wherein said transducer comprises a housing placed round said glass body, said housing being open on a light inlet side thereof.

20. The device as claimed in claim 13 comprising means for causing each said light source to supply pulsed light to each said transducer for use therewith at a pulse frequency in keeping with the inherent frequency of said transducer.

21. The device as claimed in claim 13 wherein said acoustic sensor is in the form of a microphone placed against said light pressure transducer.

22. The device as claimed in claim 13 wherein said acoustic receiver is in the form of a panorama receiver receiving the full spectrum of frequencies.

* * * * *